US008636067B2

(12) United States Patent
Robichaux et al.

(10) Patent No.: US 8,636,067 B2
(45) Date of Patent: Jan. 28, 2014

(54) METHOD AND APPARATUS FOR PERFORMING CEMENTING OPERATIONS ON TOP DRIVE RIGS

(75) Inventors: Ron D. Robichaux, Houma, LA (US); James F. Giebeler, San Bernardino, CA (US); Juan Carlos E. Mondelli, Houston, TX (US)

(73) Assignee: Blackhawk Specialty Tools, LLC, Houston, TX (US)

( * ) Notice: Subject to any disclaimer, the term of this patent is extended or adjusted under 35 U.S.C. 154(b) by 517 days.

(21) Appl. No.: 12/807,175

(22) Filed: Aug. 30, 2010

(65) Prior Publication Data

US 2011/0048710 A1 Mar. 3, 2011

Related U.S. Application Data

(60) Provisional application No. 61/275,376, filed on Aug. 28, 2009.

(51) Int. Cl.

| | |
|---|---|
| ***E21B 33/05*** | (2006.01) |
| ***E21B 23/08*** | (2006.01) |
| ***E21B 19/18*** | (2006.01) |

(52) U.S. Cl.

USPC ..... 166/285; 166/70; 166/77.51

(58) Field of Classification Search

USPC ..... 166/285, 70, 85.1, 77.51, 92.1

See application file for complete search history.

(56) References Cited

U.S. PATENT DOCUMENTS 8,381,808 B2 * 2/2013 Rogers et al. ..... 166/70

* cited by examiner

*Primary Examiner* — Brad Harcourt
*Assistant Examiner* — Wei Wang
(74) *Attorney, Agent, or Firm* — Ted M. Anthony

(57) ABSTRACT

A remotely operated lifting top drive cement head is provided having a high tensile strength, as well as the ability to swivel or rotate about a central vertical axis. The cement head permits selective launching of darts, setting plugs, balls or other objects which can be held in place within the cement head without being damaged or washed away by slurry flow, but which can be beneficially launched into said slurry flow at desired point(s) during the cementing process. The internal components of the cement head can be easily accessed using interrupted thread connections that can be quickly and easy connected and disconnected in the field without requiring specialized equipment. The cement head can be rigged up and remotely operated without requiring the lifting of personnel off the rig floor to actuate the tool or observe tool status.

12 Claims, 10 Drawing Sheets

METHOD AND APPARATUS FOR PERFORMING CEMENTING OPERATIONS ON TOP DRIVE RIGS

CROSS REFERENCES TO RELATED APPLICATION

Priority of U.S. Provisional Patent Application Ser. No. 61/275,376 filed Aug. 28, 2009, incorporated herein by reference, is hereby claimed.

STATEMENTS AS TO THE RIGHTS TO THE INVENTION MADE UNDER FEDERALLY SPONSORED RESEARCH AND DEVELOPMENT

NONE

BACKGROUND OF THE INVENTION

1. Field of the Invention

The present invention pertains to a method and apparatus for performing cementing operations in oil or gas wells. More particularly, the present invention comprises a method and apparatus for performing cementing operations in oil or gas wells equipped with top drive systems and casing running tools. More particularly still, the present invention pertains to a method and apparatus for performing cementing operations in oil or gas wells using a plug dropping cement head on rigs equipped with top drive systems and casing running tools.

2. Brief Description of the Prior Art

Conventional rotary drilling rigs typically comprise a supportive rig floor incorporating a rotary table, a substantially vertical derrick extending above said rig floor, and a traveling block or other hoisting mechanism that can be raised and lowered within said derrick. During drilling or servicing operations, such rig equipment is often used to manipulate tubular goods, such as pipe, through the rotary table and in and out of a well bore extending into the earth's crust. Once a well has been drilled to a desired depth, large diameter pipe called casing is frequently installed in such well and cemented in place. The casing is typically installed to provide structural integrity to a well bore, and to keep geologic formations isolated from one another.

When conventional drilling rigs are used, casing is typically inserted into a well in a number of separate sections of substantially equal length. Single sections of pipe called "joints," are typically screwed together or otherwise joined end-to-end at the rig in order to form a substantially continuous "string" of pipe that reaches downward into the earth's surface. As the bottom or distal end of the pipe string penetrates further into a well, additional sections of pipe are added to the ever-lengthening pipe string at the rig.

Conventional casing operations typically involve specialized crews and equipment mobilized at a rig site for the sole purpose of running casing into a well. With conventional casing operations, powered casing tongs, casing elevators and spiders, and at least one dedicated hydraulic power unit are typically required to be mobilized to a well location and installed just prior to such casing operating. Specialized casing crews must rig up and operate the equipment, connect the joints of casing to run in the well, and demobilize the equipment following completion of the job. During a conventional casing installation operation, the regular drilling crew usually plays a secondary role and typically just assists in the process.

Top drive systems, which can be used to pick up sections of pipe, connect such pipe sections together, and provide the torque necessary to drill wells, have been used on drilling rigs for some time to make-up drill pipe connections and to efficiently drill wells. However, until relatively recently, it has been a challenge to develop a viable method of using top drives systems to make-up and run casing strings, just as strings of drill pipe have historically been run.

A method of running casing using a rig's top drive system together with a casing running tool (CRT) has become increasingly popular in recent years. A drilling crew can run entire strings of casing more efficiently and for less cost than with conventional casing crews and equipment. CRT's can be used to pick up and stab single joints of casing, eliminating the necessity for personnel to be located at an elevated location on a rig, such as on the casing stabbing board. Because top drive systems can be used to provide torque to make up casing connections, specialized casing tongs are not required. Further, fewer personnel are needed on and around the rig floor during the casing running operations, resulting in faster and more efficient casing installation.

In most cases, a CRT is connected immediately below a rig's top drive unit prior to commencement of casing operations. A single-joint elevator, supported by a CRT, is typically used to lift individual joints of casing from a V-door or pipe rack to a well. In this manner, each joint of casing is stabbed into the previous joint (already installed in a well), and the top drive and attached CRT are lowered until the CRT covers the top of the new joint being added. The slips of the CRT are set on the joint of casing, and the top drive is actuated to apply the required torque (through the CRT) to make up the casing connection.

Cementing operations can be made more complicated by the use of CRT's and associated equipment. During such casing operations, a cement head is typically installed to provide a connection or interface between a CRT and a casing string extending into a well that must be cemented in place. Such cement heads should beneficially permit cement slurry to flow from a pumping assembly into a well, and should have sufficient flow capacity to permit high pressure pumping of large volumes of cement and other fluids at high flow rates.

Such cement heads should also have sufficient tensile strength to support heavy weight tubulars extending from the surface into a well, and to accommodate raising and lowering of such tubular goods without interfering with and/or intermittently stopping longitudinal and/or rotational movement of a casing string. It is frequently considered good practice to rotate and/or reciprocate a string of casing while such casing is being cemented in a wellbore in order to facilitate better cement distribution within the annular space between the outer surface of the casing and the inner surface of a well bore. Cement heads should also beneficially swivel in order to permit rotation of the tubular goods and/or other downhole equipment in a well while maintaining circulation from the surface pumping equipment into the down hole casing string extending into the well.

Darts, balls, plugs and/or other objects, typically constructed of rubber, plastic or other material, are frequently pumped into a well in connection with cementing operations. In many instances, such items are suspended within a cementing head until the objects are released or "launched" at desired points during the cement pumping process. Once released, such items join the cement slurry flow and can be pumped down hole directly into a well. Such darts, balls, plugs and/or other objects should be beneficially held in place within the slurry flow passing through the cement head prior to being launched or released without being damaged or washed away by such slurry flow.

In most cases, cement heads comprise multiple sections or "subs" that are connected using threaded connections. In order to ensure that such threaded connections form fluid seals that can withstand expected pressures, and that the joined components exhibit necessary tensile strength, such connections are typically made up at a facility or other staging location prior to transportation of a cement head to a rig or other work site. As a result, it is typically very difficult and time consuming to separate the various components of a cement head when access to the internal components of such cement head is required at a well location. Although there are many different reasons why such access may be required, common examples include the need to inspect plugs, darts, balls or other objects, or to reload such items within a cement head. Frequently, specialized equipment is needed to connect or disconnect the components of a cement head at a well location, making such operations expensive, inconvenient and/or otherwise undesirable.

Thus, there is a need for a cement head that permits cement flow into the cement head from above, and has a high tensile strength as well as the ability to rotate or swivel. Valves used to isolate or restrict flow through the cement head, as well as launching mechanisms for releasing darts, balls, plugs and/or other objects into the slurry flow, should be remotely actuated from a safe distance thereby eliminating the need for lifting personnel overhead. Audible and/or visual indicators should also be provided to alert personnel on or in the vicinity of the rig floor about the operation of various elements of the tool and/or the status of objects launched into a well.

Additionally, there is a need for a cement head that permits quick and efficient connection and/or disconnection of the major components of such cement head at a rig site or other remote location (such as, for example, when access to the internal components of the cement head is desired). Such connection and/or disconnection should be relatively quick and efficient, and should not require use of specialized equipment or excessive personnel.

SUMMARY OF THE PRESENT INVENTION

The present invention comprises a cement head apparatus to be used during cementing operations that permits cement flow through said apparatus and into a wellbore below. The cement head apparatus of the present invention can be used in connection with many different cementing operations including, without limitation, the cementing of casing strings installed using top drive systems and/or CRT equipment requiring minimal personnel present on the rig floor.

The cement head of the present invention has a high tensile strength, as well as the ability to swivel or rotate about a central (typically vertical) axis. Further, the cement head of the present invention also permits the use of darts, setting plugs, balls, wipers and/or other objects which can be held in place within the cement head without being damaged or washed away by cement slurry flow, but which can be beneficially launched or released into said slurry flow at desired points during the cementing process without slowing down or stopping pumping operations.

It is to be observed that the cement head assembly of the present invention can be constructed in many different configurations without departing from the scope or novelty of the invention. In the preferred embodiment, the cement head assembly of the present invention comprises: (1) an upper sub (pump-in or side-entry sub) having a central flow bore that may optionally rotate, and that includes a kelly valve or control valve that can be used in conjunction with wellbore fluid fill-up tools of CRT devices, frequently connected via a top pup casing; (2) a central body member having a central flow bore and an internal flow around cage that holds plugs or other items until launching of such plugs or other items is desired; and (3) a lower sub having a central flow bore that can include optional tattletale device that can signal passage of a plug or other item via mechanical devices, proximity indicators, pressure signals or other means. Such lower sub assembly can be connected to a well's casing string via a bottom casing pup.

Said upper sub can include a fluid communication swivel assembly that beneficially permits fluid communication from a fluid supply/reservoir (such as a hydraulic fluid supply reservoir) to fluid-driven motors that provide power to actuators. The swivel generally permits the cement head of the present invention to rotate without tangling or breaking of hydraulic lines used to supply such fluid to the fluid-driven motors. At least one remotely actuated control valve can also be mounted at or near the top of said upper sub, and can be used to selectively isolate fluid flow into said cement head. A torque stabilization device can be included to provide a stable platform to prevent lateral movement of said cement head while it is being rotated.

In the preferred embodiment, said central body member can include a flow-around cage assembly disposed within its central flow bore. At least one remotely-actuated pin puller having an override feature is also provided. Each pin puller comprises a side entry retractable pin sub used to suspend darts, wiper balls, plugs and/or the like within the flow around cage assembly until launching of said objects is desired. Each of said at least one pin pullers also have a manual override system that allows for operation of such pin pullers should an automated actuator fail to work, or should the unit be deliberately used in the manual mode.

Once launched, such plugs or other items can move downward into a wellbore below via a tapered funnel-like inner profile. Such plugs or other items are motivated into such wellbore through gravity feed, but can also be assisted by fluid pressure exerted on the plugs or other items from above. As fluid gathers on top and around a launched plug or other item, the tapered funnel inner profile of the cement head of the present invention permits pressure to increase above such plugs or other items, thereby forcing such plug or other item downward into the well bore.

At least one observation port or window is provided to permit visual observation of objects (such as darts, setting plugs, wipers or the like) that are suspended in a pre-launch static stage. Additionally, at least one open/close indicator provides a visual display to allow observers (including those at or near the rig floor) to determine whether valves are in the fully open or fully closed positions. Plugs (bull plugs and/or blank-off caps) are attached the body of the cement head assembly and may be beneficially removed to confirm proper plug loading before, during or after a job, are held close and prevented from falling by a hinged scissor link pivotally attached to the tool and by a yoke to the bull plug.

An optional internal passage indicator can also be provided. Said indicator can take many forms, but in the preferred embodiment comprises a light emitting device and/or audible tone. The indicator can beneficially signal passage to observers (including those at or near the rig floor) of objects launched such as wiper balls, plugs, darts, trip activation balls, and the like though the central bore of the cement head.

In the preferred embodiment, the upper sub is attached to the central body member, and the central body member is attached to the lower sub, using "interrupted screw" or "interrupted thread" connections. Such connections allow for partial insertion and minimal rotation yet provide required tensile strength and form a fluid pressure seal. As described more fully below, each such connection comprises mating "pin end" and "box end" connectors. Said pin end and box end connectors have corresponding sections of thread removed; that is, where the pin end connector has threads, a mating box end connector does not have threads, and vice versa. The tapered pin end connector can thus be inserted into the box end connector, after which less than a complete rotation will engage the two sets of threads securely against one another.

A spline torque ring ("STR") permits the transfer of torque through the cement head of the present invention without permitting said interrupted thread connections to become detached or disconnected. Each STR generally comprises a ring having spline teeth inwardly disposed in mating slots to transmit torque into engaging face dogs. In the preferred embodiment, eccentric cams pivotally attached to the subs can rotate in rectangle windows in each STR to raise or lower (and engage or disengage) said STR.

Such connections can be used to quickly and efficiently separate various components of a cement head when access to internal components of such cement head is required at a well location. Although there are many different reasons why such access may be required, common examples include the need to inspect plugs, darts, balls or other objects, or to reload such items within a cement head. Such components can be easily and efficiently connected and/or disconnected at a rig, well site or other remote location by one or two workers without the need for specialized equipment.

Cement head lines, such as control lines, cement supply lines and torque/rotation tie off lines can all be beneficially attached to the cement head of the present invention while it is on the rig floor. Such lines are kept away from any handling hardware. Further, this capability of the present invention eliminates the need for lifting personnel to an elevated location on a riding belt or basket in order to attach such lines. After all necessary connections are made, the cement head of the present invention is stabbed in place on the rig floor, any remaining connections can also be made on the rig floor. This feature eliminates the need for hardware to be lifted and hammered in place high off of the rig floor, thereby eliminating the significant risks associated with dropped objects.

BRIEF DESCRIPTION OF THE DRAWINGS

The foregoing summary, as well as the following detailed description of the preferred embodiments, is better understood when read in conjunction with the appended drawings. For the purpose of illustrating the invention, the drawings show certain preferred embodiments. It is understood, however, that the invention is not limited to the specific methods and devices disclosed.

DETAILED DESCRIPTION OF A PREFERRED EMBODIMENT OF THE INVENTION

Existing prior art cement heads typically include valves, dart launching device(s) and/or ball dropper(s) that must be actuated using physical manipulation. As such, when said prior art cement heads are mounted a significant distance above a rig floor, which is frequently required during cementing operations, personnel must be lifted off the rig floor to an elevated location using a makeshift seat or harness attached to a hoist or other lifting device in order to permit such personnel to physically access said cement head in order to actuate valves and/or to launch darts, balls, plugs or other items. In such cases, personnel are placed at great risk of falling and suffering serious injury or death, and can drop wrenches or other heavy tools on people or equipment located on the rig floor below. The cement head of the present invention, which can be connected at the rig floor and actuated remotely, reduces or eliminates many of these risks associated with conventional cement heads.

Figure 1A:
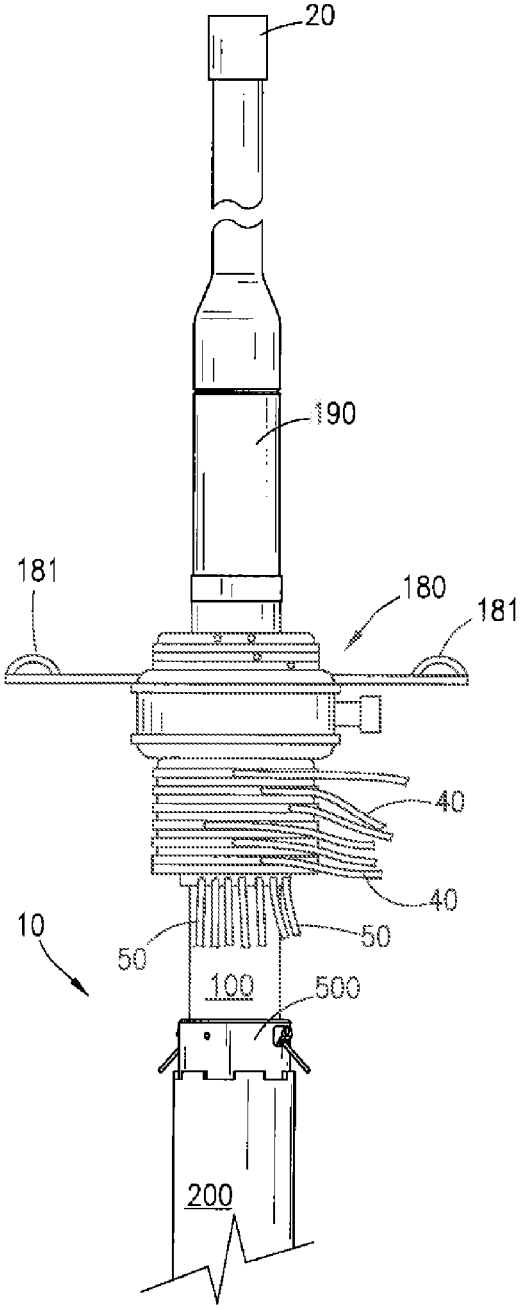
FIGS. 1A and 1B each depict a partial side view of the cement head of the present invention.
Figure 1B:
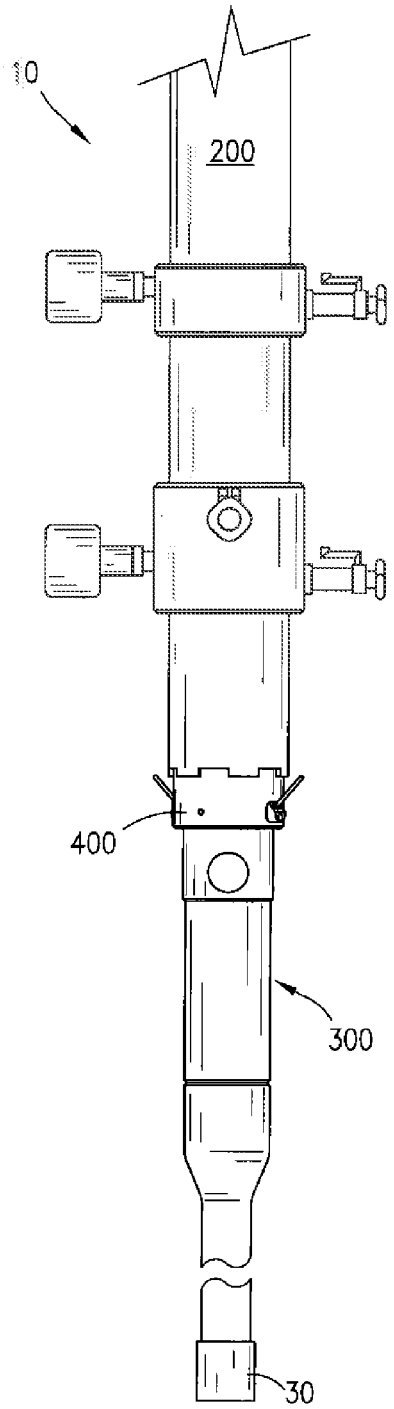

FIGS. 1A and 1B depict side views of portions of cement head assembly 10 of the present invention. Although cement head assembly 10 of the present invention can be constructed in many different configurations without departing from the scope or novelty of the invention, in the preferred embodiment, said cement head assembly 10 of the present invention comprises upper sub assembly 100, central body assembly 200 and lower sub assembly 300. Spline torque rings 400 and 500, described in detail below, permit the transfer of torque through the cement head of the present invention without allowing connections between said assemblies to become detached or disconnected.

Still referring to FIG. 1, torque stabilization assembly 180 can be included to provide a stable platform to prevent lateral movement of said cement head while it is being rotated. Torque stabilization device 180, typically having connection eyelets or loops 181 for attachment of chains or other securing means, can be provided to hold cement head assembly 10 in place. Said torque stabilization device can be chained or tied-off to surrounding equipment to provide a stable platform to hold cement head assembly 10 steady while the work string and/or other components of cement head assembly 10 are rotated.

In the preferred embodiment, cement head assembly 10 of the present invention will include an upper box-end connector 190 for attachment to a casing pup joint or lifting means, such as upper casing pup 20. Similarly, referring to FIG. 2B, cement head assembly 10 will beneficially include a lower pin-end connector 301 for connection to casing string or other tubular goods extending into a well, such as lower casing pup 30.

Figure 2A:
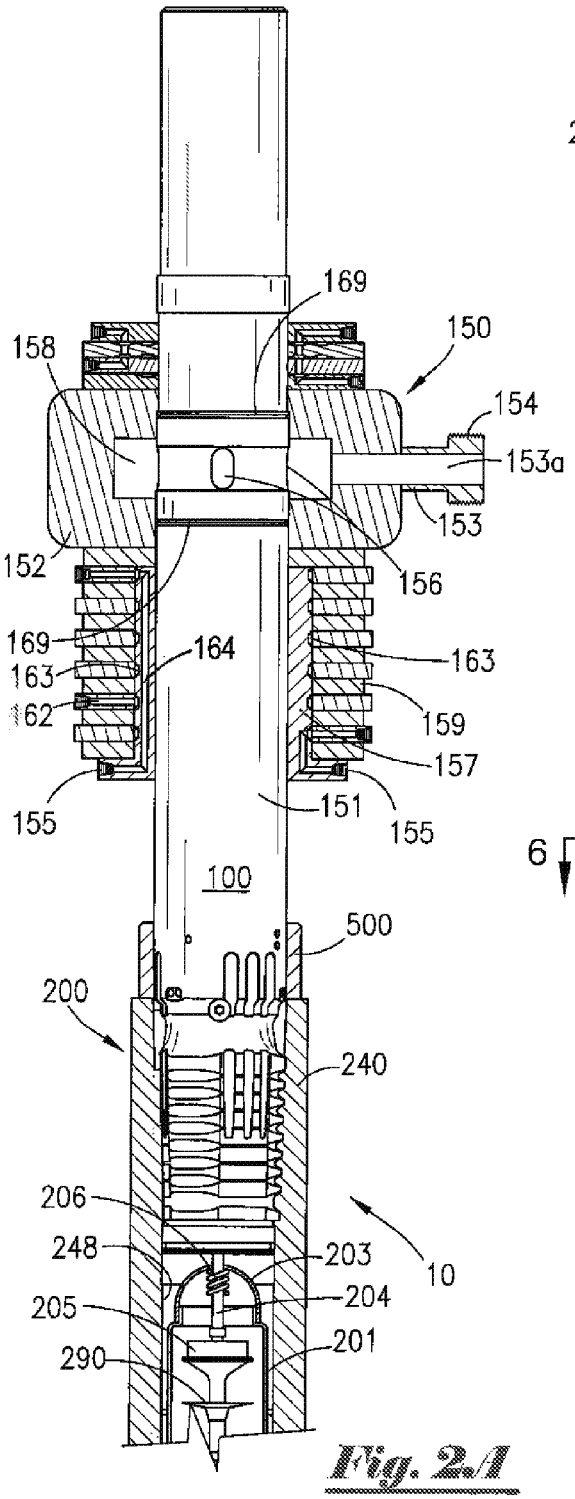
FIGS. 2A and 2B each depict partial section views of a portion of the cement head of the present invention.
Figure 2B:
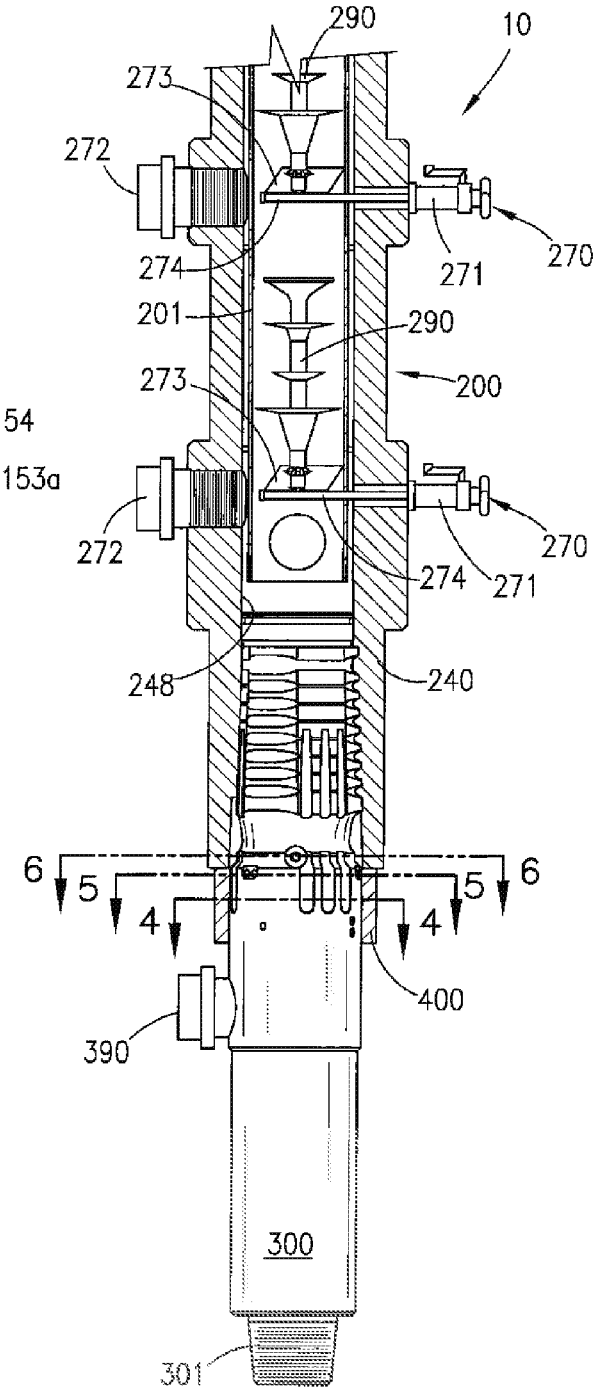

FIG. 2A depicts a side section view of an upper portion of cement head assembly 10 of the present invention, while FIG. 2B depicts a lower portion of cement head assembly 10. As depicted in FIG. 2A, said upper sub assembly 100 can include a fluid communication swivel assembly 150 that beneficially permits fluid communication from a fluid supply/reservoir (such as a hydraulic fluid supply reservoir) to fluid-driven motors that provide power to actuators used in connection with the operation of cement head assembly 10. Specifically, said fluid communication swivel assembly 150 generally permits the cement head of the present invention to rotate without tangling or breaking of hydraulic lines used to supply such fluid to the fluid-driven motors associated with cement head assembly 10. It is to be observed that, as used herein, the term "fluid" is defined broadly to include any substance, such as a liquid or gas, that is capable of flowing and that changes its shape at a steady rate when acted upon by a force tending to change its shape.

Although not depicted in FIG. 2A, at least one remotely actuated control valve can also be mounted at or near the top of said upper sub assembly 100, and can be used to selectively isolate fluid flow into cement head assembly 10 from a top drive unit or CRT situated above said cement head assembly 10.

Still referring to FIG. 2A, mandrel 151 comprises a substantially tubular body having a central longitudinal flow bore 161 extending therethrough (said flow bore not shown in FIG. 2A). Mandrel 151 supports flow ring housing 152 having side inlet sub 153 with threaded or flanged connection 154. Flow ring housing 152 comprises an outer housing defining a closed system for contained flow of drilling mud, cement, slurry, and/or other fluids into cement head assembly 10 via inlet sub 153. During swivel operations, flow ring housing 152 remains static while mandrel 151 is capable of rotation about its central longitudinal axis. Flow ring housing 152 permits the transfer of fluids pumped into side inlet sub 153 to mandrel 151, even during rotation, via a series sealed chambers and drilled bores described in detail below.

Still referring to FIG. 2A, a plurality of ports 156 are provided in mandrel 151. In the preferred embodiment, ports 156 are linearly aligned. Flow ring housing 152 has internal chamber 158 in fluid communication with flow bore 153*a* of side inlet sub 153. A plurality of sealing elements 169 are disposed above and below chamber 158, and provide a pressure seal between mandrel 151 and flow ring housing 152, whether in a static or dynamic (rotating) relationship. In the preferred embodiment, sealing elements 169 comprise elastomeric seals.

Fluid (such as, for example, drilling mud or cement slurry) can be pumped through flow bore 153*a* of side inlet sub 153, into chamber 158, through apertures 156, and into the central flow bore of mandrel 151. In this manner, fluid can be pumped into cement head assembly 10 from an outside source or supply through fluid communication swivel assembly 150 when mandrel 151 is static, or when said mandrel 151 is rotating about its central longitudinal axis within flow ring housing 152.

Supply lines or hoses can be connected to inlet sub 153 using standard threaded connections. However, in the preferred embodiment, such supply lines or hoses can be connected to inlet sub 153 via flanged connector 154. Additionally, a valve can be provided to allow or restrict flow into side inlet sub 153. Connection of such supply lines or hoses to connector 154 using flanged connections is preformed at the rig floor, not at an elevated location. Such connection becomes a secure part of the assembly, and is much less likely to be inadvertently dropped via loosened threaded connection, or easily knocked off by contact with other items.

Still referring to FIG. 2A, fluid communication swivel assembly 150 also facilitates fluid transfer, during static or rotating operations, from a fluid power pump (such as, for example, a hydraulic pump) to fluid-driven motors used to remotely operate the present invention including, without limitation, actuation of said motors.

Lower swivel body member 159 is connected to flow ring housing 152. In the preferred embodiment, a plurality of transverse bores 162 extends through lower swivel body member 159. A plurality of recessed grooves 163 extends around the outer circumference of inner swivel mandrel 157 (which is attached to and rotates with mandrel 151); each such recessed groove 163 is aligned with a transverse bore 162. At least one vertical flow tube 164 extends from each such transverse bore 162 through the body of inner swivel mandrel 157 (substantially parallel to longitudinal axis of mandrel 151) and exits inner swivel mandrel 157; each such flow tube 164 terminates at a port 155 (which, in the preferred embodiment, may be threaded to accommodate connection of a conventional fitting). Sealing elements are disposed on the sides of each recessed groove 163 in order to provide a fluid seal between rotatable inner swivel mandrel 157 and lower swivel body member 159.

Hoses or other conduits 50 (not shown in FIG. 2A but visible in FIG. 1) connect ports 155 with one or more fluid power pumps utilized in connection with cement head assembly 10 of the present invention. Such fluid is provided via supply lines 40 connected to inlets of transverse bores 162. As noted above, fluid communication swivel assembly 150 permits the cement head of the present invention to rotate without tangling or breaking of hydraulic lines 50 used to supply fluid to the fluid-driven motors associated with cement head assembly 10. Such supply lines 40 and 50 can be attached to parts in swivel assembly 150, or fluid driven motors of cement head assembly 10, as applicable via "quick-connect" fittings that permit fast and efficient connection and disconnection thereof.

Referring to FIGS. 2A and 2B, central body assembly 200, connected to upper sub assembly 100, comprises body member 240 having a central flow bore 248 and internal flow around cage 201 that holds plugs or other items until launching of such plugs or other items is desired. Internal flow around cage 201 is beneficially supported and aligned within central body member 240. Said flow around cage 201 is further supported and aligned with pin puller assemblies 270, and observation ports 272. Darts 290 are disposed in static state within said tubular body 201.

In the preferred embodiment, each pin puller assembly 270 comprises a side entry retractable pin sub used to suspend darts, wiper balls, plugs and/or the like within flow around cage 201 until launching of said objects is desired. In the preferred embodiment, each of said at least one pin puller 270 also has a manual override system that allows for operation of such pin pullers should an automated actuator fail to work, or should the unit be deliberately used in a manual mode. Further, each of said at least one pin pullers 270 has two visual indications of activation and stroke completion by visually observable rotating bonnet and flap pin that becomes visible at end of motion.

Referring to FIG. 2A, said flow around cage 201 further comprises top cap 203 that allows some limited flow through said cap and into cage 201. Catapult pole 204 is slidably disposed through a bore extending through said top cap 203. Catapult pole 204 also has a substantially flat disk 205 at its lower end to prevent top damage to darts 290 (or other objects within cage assembly 201), and to prevent lodging of said darts 290 between catapult pole 204 and the inner surface of cage tubular body 201. Biasing spring 206 is provided for energizing catapult pole 204.

In the preferred embodiment, each of said pin puller assemblies 270 comprises a side-entry retractable pin sub that is used to suspend droppable objects (such as, for example, darts, wiper plugs, balls and the like) within cement head assembly 10. Fluid driven motor 271 is a mechanical device used to power an actuator for said pin puller assembly 270. In the preferred embodiment, observation port 272 is provided and includes a transparent window-like device to visually/physically observe a droppable object (such as, for example, dart 290) being suspended in the pre-drop static stage. This can be especially significant for field personnel that may not have been present during loading of such droppable object. Observation port 272 allows such field personnel to check, inspect, manipulate, record, read and/or test the pre-dropped object on location, which can save rig time by permitting, but not requiring, field-loading of such objects.

Trap doors 273, typically provided in pairs, are hinged and suspended/supported by pin 274, which is in turn connected to pin puller motor 271. When launching of dart 290 is desired, pin puller motor 271 is actuated to retract pin 274. In such case, trap door 273 is permitted to open, thereby allowing passage of suspended objects such as darts 290. The aforementioned apparatus prevents/reduce pre-mature launching of an object around pin 274, and/or lodging of a head bypass (leading surface) of dart 290 between pin 274 and inner surface of flow around cage 201. Pin 274 provides a stable and reliable platform to suspend trap door 273 that in turn support/retain the pre-dropped dart 290. Said trap door 273 (or trap door pairs) also act to cup and retain pre-dropped dart 290 to prevent premature launch of said dart 290 and also reduce the chance for bypass around the pin during high or turbulent flow.

Observation port 272 also allows an observer to insert a tool or instrument to manipulate a pre-loaded object, or to deploy objects directly into the device in the field. Observation port 272 also allows for addition of non-ferrous material, whether obscure, semi-obscure, or transparent, for wireless communication and identification of pre-drop object using magnetic, radio frequency, infrared, or any other communication median. Observation port 272 also allows for addition of fluid monitor sensors that can monitor different variables including, without limitation, resistivity, obscuration, reflection, temperature and/or fluid-specific characteristics. Further, said sensors may be used to trigger automated functions with said onboard motors and valves described herein. Manual override systems allow for operation of pin puller assemblies 270 if any actuator should fail to work or if the unit is deliberately used in the manual mode.

Once launched, such plugs or other items (such as, for example, darts 290) can move downward into a wellbore below via an optional tapered funnel-like inner profile. Such plugs or other items are motivated into such wellbore through gravity feed, but can also be assisted by fluid pressure exerted from the cage inlets on the plugs or other items. As fluid gathers on top and around a launched plug or other item, the tapered funnel inner profile of the cement head of the present invention permits pressure to increase above such plugs or other items, thereby beneficially forcing such plug or other item downward into the well bore.

In the preferred embodiment, lower sub assembly 300 is connected to central body assembly 200. Resetting internal passage indicator 390 is provided to indicate passage of droppable objects used downhole (such as, for example, wiper balls, plugs, darts, trip activation balls, etc.) through the bore of said cement head. In the preferred embodiment, said internal passage indicator 390—also referred to as a "tattle-tale" —provides a signal such as a bright illuminating visual indication and/or a noticeable audible tone. Alternatively, resetting internal passage indicator 390 can comprise a mechanical signaling device, such as a flag, a lever moving up or down, a wheel spinning clockwise or counterclockwise, and/or other visual indicators.

Further, valves can also be optionally provided (having an actuator operated by fluid movement) that can selectively open and close said cement head assembly 10. Such valve can be used to isolate flow through an inner bore of the lower sub assembly 300, and to/from the well or other items situated below cement head 10. An open/close indicator can be provided to display to observer(s) whether such valve is fully open or closed which is essential to mitigate equipment damage from flow washout. In the preferred embodiment, lower sub assembly 300 has a conventional threaded "pin-end" threaded connection 301 to connect cement head assembly 10 to a workstring, pup joint or any other below item in the string. In most cases, such equipment will be threadably attached to a casing pup that is in turn connected to a casing string being installed in a wellbore.

Plugs (bull plugs and/or blank-off caps) can also be attached to cement head assembly 10 and may be beneficially removed to confirm proper plug loading before, during or after a job, are held close and prevented from falling by a hinged scissor link pivotally attached to the tool and by a yoke to the bull plug.

Still referring to FIGS. 2A and 2B, in the preferred embodiment, upper sub assembly 100 is attached to central body assembly 200 using "interrupted screw" or "interrupted thread" connections. Similarly, central body assembly 200 is likewise attached to lower sub assembly 300 using "interrupted screw" or "interrupted thread" connections. Each such connection comprises mating "pin end" and "box end" connectors. Said pin end and box end connectors have corresponding sections of thread removed; that is, where the pin end connector has threads, the box end connector does not, and vice versa. Much like a "cannon breech" loading mechanism, the tapered pin connector can be inserted into the box end connector, after which less than a complete rotation will engage the two sets of mating threads securely against one another. Such connections allow for partial insertion and minimal rotation to provide required tensile strength and form a fluid pressure seal between connected components.

Spline torque rings 400 and 500 permit the transfer of torque through the components of cement head assembly 10 of the present invention without permitting said interrupted thread connections to become detached. Spline torque rings 400 and 500 are substantially identical, except that spline torque ring 500 is oriented to engage against the upper end of central body assembly 200, while spline torque ring 400 is oriented in the opposite direction to engage against the lower end of central body assembly 200.

In the preferred embodiment, each of spline torque rings 400 and 500 generally comprise a ring having a plurality of spline teeth inwardly disposed. Upper sub assembly 100 is concentrically received within spline torque ring 500, while lower sub assembly 300 is received within spline torque ring 400. As described in detail below, spline teeth of each spline torque ring are received within mating slots to permit the transmission of torque through cement head assembly 10. In the preferred embodiment, eccentric cams can rotate in within substantially rectanglular windows in each spline torque ring in order to raise or lower (and engage or disengage) said spline torque ring.

Figure 3:
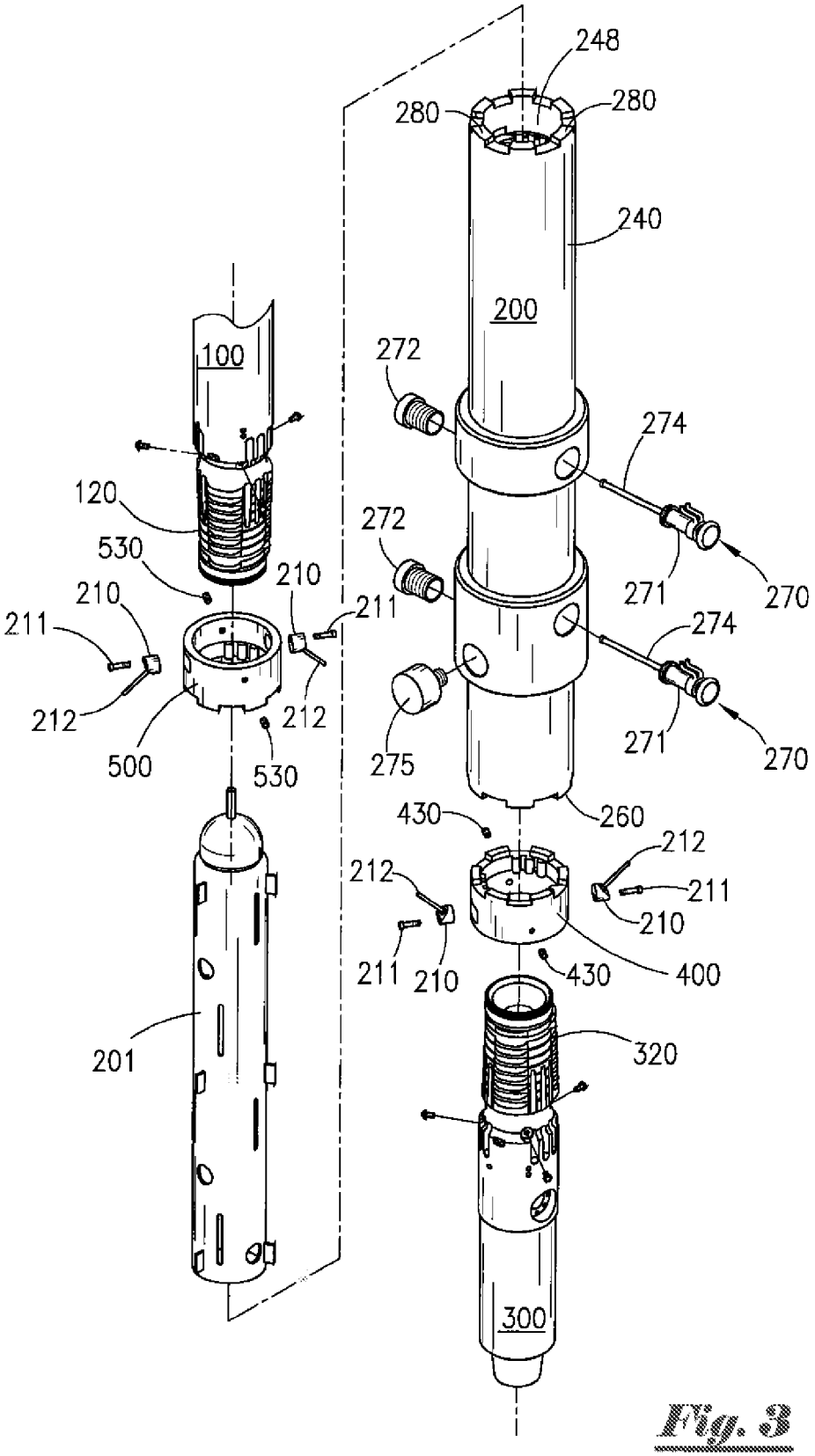
FIG. 3 depicts an exploded view of a locking end connector of the present invention.

FIG. 3 depicts an exploded view of locking end connections of the present invention. Flow around cage 201 is concentrically disposed within central bore 248 of body member 240 of central body assembly 200. Pin puller assemblies 270 having fluid driven motors 271 and retractable pins 274, as well as observation ports 272 and bull plug(s) 275, are provided.

In the preferred embodiment, the upper surface of central body member 240 has upper face dogs 280; said upper face dogs comprising a set of alternating projections and recesses along the upper surface of body member 240. Similarly, in the preferred embodiment, the lower end of central body member 240 has lower face dogs 260; said lower face dogs comprising a set of alternating projections and recesses along the lower surface of body member 240. Pin end connector 120 is concentrically received within upper spline torque ring 500, and upper spline torque ring 500 is slidably disposed on pin end connector 120 of upper sub assembly 100. Pin end connector 320 is concentrically received within lower spline torque ring 400, and lower spline torque ring 400 is slidably disposed on pin end 320 of lower sub assembly 300.

Such connections can be used to quickly and efficiently separate the various components of a cement head when access to the internal space or components of such cement head is required at a well location. Although there are many different reasons why such access may be required, common examples include the need to physically access plugs, darts, balls or other objects, or to reload such items within a cement head. Such components can be easily and efficiently connected and/or disconnected at a rig, well site or other remote location by one or two workers without the need for specialized equipment.

Figure 22:
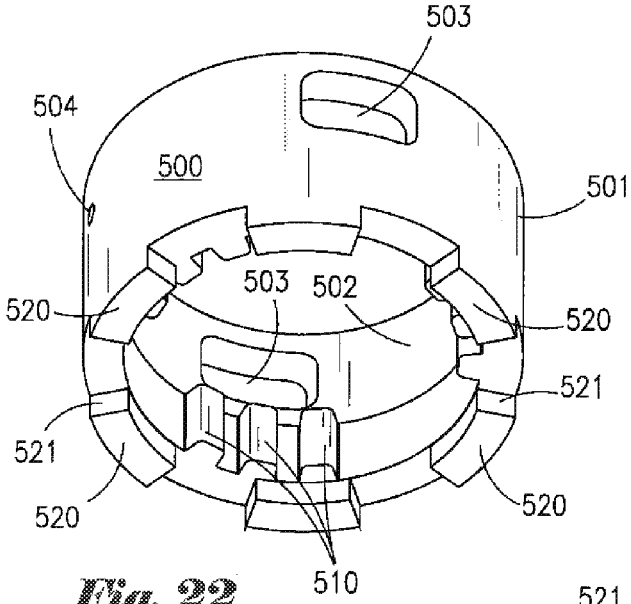
FIG. 22 depicts a perspective view of a spline torque ring of the present invention.

FIG. 22 depicts a perspective view of spline torque ring 500 of the present invention. Spline torque ring 500 comprises ring body 501 defining curved inner surface 502. Substantially rectangular apertures 503 and internally threaded set screw bores 504 extend through ring body 501. A plurality of rigid spline teeth 510 are disposed along said inner surface 502 of ring body 501. In the preferred embodiment, said spline teeth 501 project radially inward toward the center of ring body 501; said spline teeth 510 are elongate, and are oriented substantially parallel to the longitudinal axis of ring body 501.

Still referring to FIG. 22, a plurality of face dogs 520 are disposed along one edge of body member 510. Said face dogs 520 define lateral shoulders 521 that can be used to support loading and transfer torque when said face dogs 520 are joined with mating face dogs of another component (such as, for example, face dogs 280 of central body assembly 200).

Figure 23:
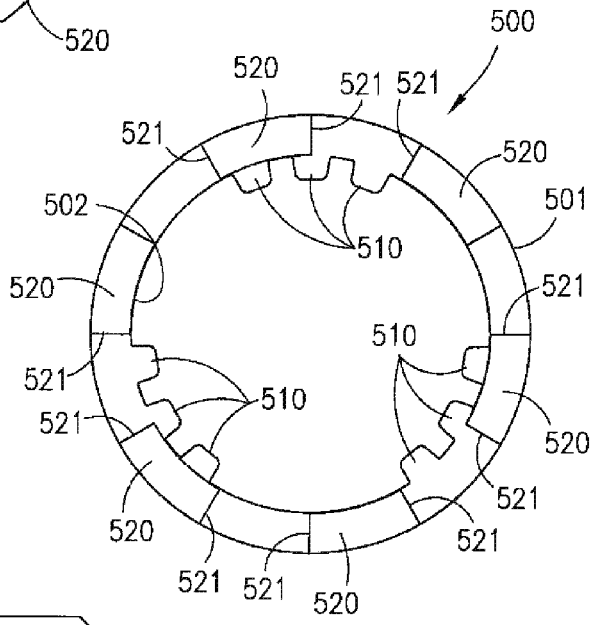
FIG. 23 depicts an end view of a spline torque ring of the present invention.
Figure 24:
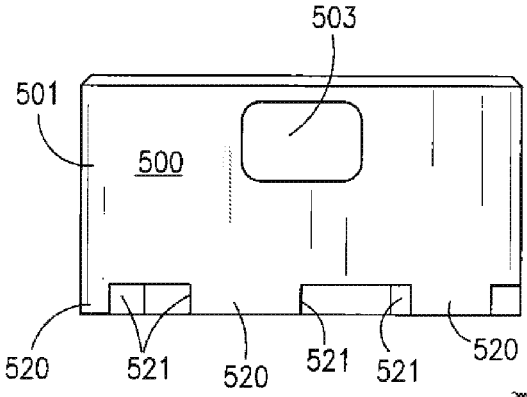
FIG. 24 depicts a side view of a spline torque ring of the present invention.

FIG. 23 depicts an end view of a spline torque ring 500 of the present invention. Spline torque ring 500 comprises ring body 501 defining curved inner surface 502. A plurality of spline teeth 510 are disposed along said inner surface 502 of ring body 501 and extend radially inward toward the central axis point of ring 500. Face dogs 520 defining lateral shoulders 521 are disposed along an edge of body member 510. FIG. 24 depicts a side view of a spline torque ring 500 of the present invention. Substantially rectangular aperture 503 extends through ring body 501. A plurality of face dogs 520 extend along an edge of body member 510, said face dogs 520 defining shoulders 521 that can be used to support loading and transfer torque.

Figure 7:
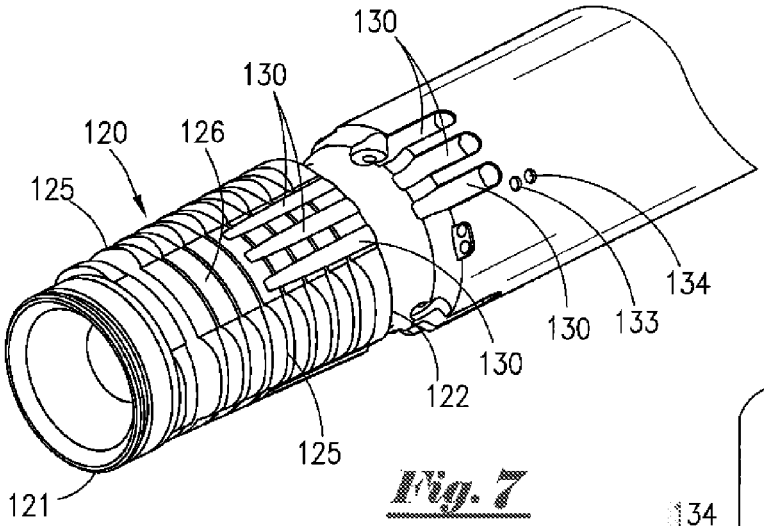
FIG. 7 depicts a perspective view of a pin end connector of the present invention.

FIG. 7 depicts a perspective view of pin end connector 120 of the present invention. Pin end connector 120 is tapered, such that the outer diameter of said pin end connector 120 gradually decreases in size toward distal end 121 from starting point 122 of threads 125. Pin end connector 120 has an interrupted screw thread pattern; that is, threads 125 are disposed only partially around the circumference of pin end thread connector 120. Areas having substantially flat surface(s) 126 exist between said threaded sections, such that threads 125 do not extend continuously around the entire circumference of pin end connector 120.

A plurality of spline grooves 130 is provided. In the preferred embodiment of the present invention, said spline grooves 130 are oriented substantially parallel to the longitudinal axis of pin end connector 120, while first set screw bore 133 and second set screw bore 134 are disposed in upper sub assembly 100 transverse to said longitudinal axis.

Figure 8:
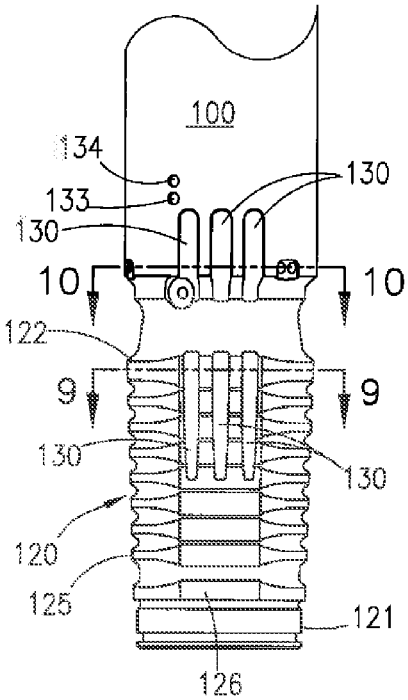
FIG. 8 depicts a side view of a pin end connector of the present invention.

FIG. 8 depicts a side view of pin end connector 120 of the present invention. Pin end connector 120 has a smaller outer diameter at distal end 121 than at starting point 122 of threads 125. Threads 125 are disposed only partially around the outer circumference of pin end thread connector 120, with substantially flat area 126 existing between threaded sections. A plurality of elongate spline grooves 130 are oriented substantially parallel to the longitudinal axis of pin end connector 120. First set screw bore 133 and second set screw bore 134 are disposed in upper sub assembly 100.

Figure 9:
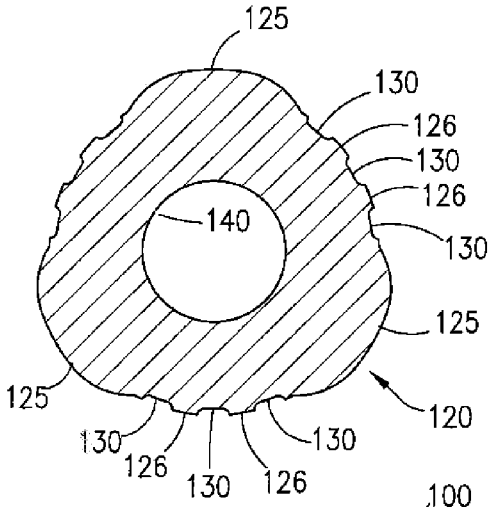
FIG. 9 depicts a section view of a pin end connector of the present invention along line 9-9 of FIG. 8.
Figure 10:
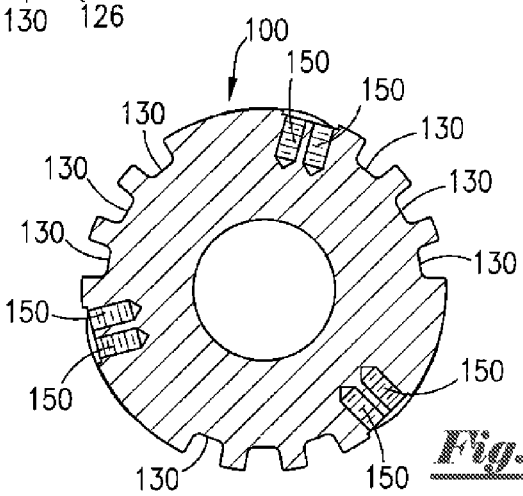
FIG. 10 depicts a section view of lower sub assembly of the present invention along line 10-10 of FIG. 8.

FIG. 9 depicts a section view of pin end connector 120 of the present invention along line 9-9 of FIG. 8, while FIG. 10 depicts a section view of upper sub assembly 100 of the present invention along line 10-10 of FIG. 8, near pin end connector 120. Referring to FIG. 9, pin end connector 120 has central flow bore 140. Threads 125 extend radially outward from said pin end connector 120, but said threads do not extend continuously around the entire circumference of said pin end connector 120. Areas having substantially flat surface(s) 126 are disposed between said threaded sections. A plurality of spline grooves 130 are aligned with, and recessed into, said substantially flat surface(s) 126 and are oriented substantially parallel to the longitudinal axis of pin end connector 120. Referring to FIG. 10, upper sub assembly 100 has central flow bore 140 therethrough. A plurality of spline grooves 130 are oriented substantially parallel to the longitudinal axis of pin end connector 120. Transverse bores 150, grouped in pairs, are provided around said upper sub assembly 100.

Figure 11:
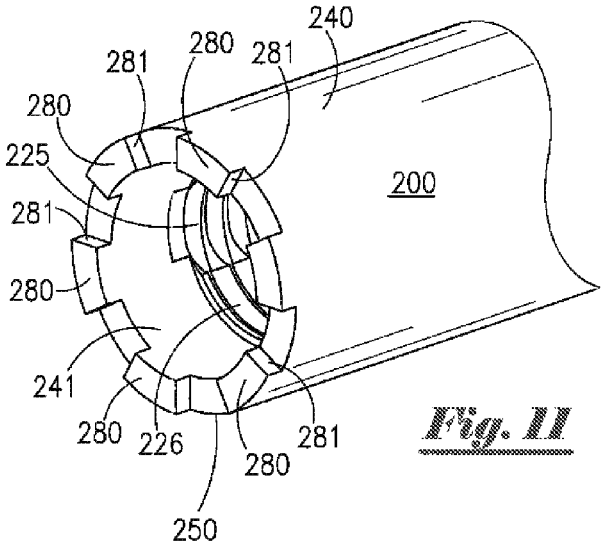
FIG. 11 depicts a perspective view of a box end connector of the present invention.

FIG. 11 depicts a perspective view of end 250 of central body assembly 200 defining a box end connector for mating with a pin end connector (such as, for example, pin end connector 120 of upper sub assembly 100). End 250 of central body assembly 200 comprises body member 240 having central flow bore 248 extending therethrough that defines curved inner surface 241. Inner surface 241 has an interrupted screw thread pattern; that is, threads 225 are disposed only partially around the circumference of curved inner surface 241 of central body assembly 200. Areas having substantially flat surface(s) 226 are positioned between said threaded sections, such that threads 225 do not extend continuously around the entire inner circumference of curved inner surface 241 of central body assembly 200.

Figure 12:
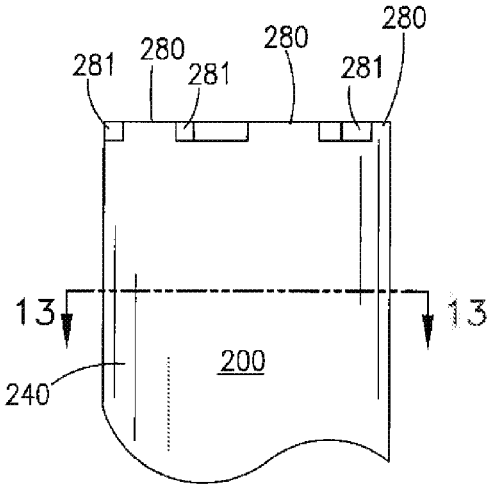
FIG. 12 depicts a side view of a box end connector of the present invention.

Still referring to FIG. 11, a plurality of face dogs 280 are disposed along an edge of body member 240. Said face dogs 280 define lateral shoulders 281 that can be used to support loading and transfer torque when said face dogs 280 are joined with mating face dogs of another component (such as, for example, face dogs 520 of spline torque ring 500). FIG. 12 depicts a side view of end 250 of central body assembly 200 defining a box end connector. A plurality of face dogs 280 define lateral shoulders 281.

Figure 13:
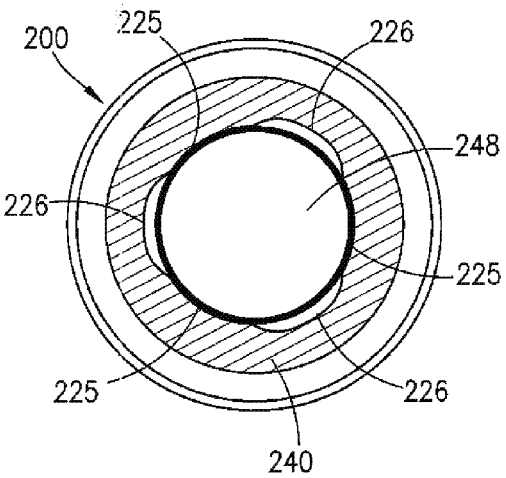
FIG. 13 depicts a section view of a box end connector of the present invention along line 13-13 of FIG. 12.

FIG. 13 depicts a section view of central body assembly 200 of the present invention along line 13-13 of FIG. 12. Body member 240 has flow around cage 201 disposed within central flow bore 248. Internal threads 225 having interrupted screw pattern are disposed only partially around the circumference of central flow bore 248. Areas having substantially flat surface(s) 226 are positioned between said threaded sections, such that threads 225 do not extend continuously around the entire inner circumference of central flow bore 248.

Referring back to FIG. 3, eccentric cams 210 are pivotally mounted to upper sub assembly 100 and lower sub assembly 300 using pivot pins 211. Levers 212 are attached to eccentric cams 210, and can be used to apply rotational force to eccentric cams 210 in order to rotate said cams about pivot pins 211.

Figure 20:
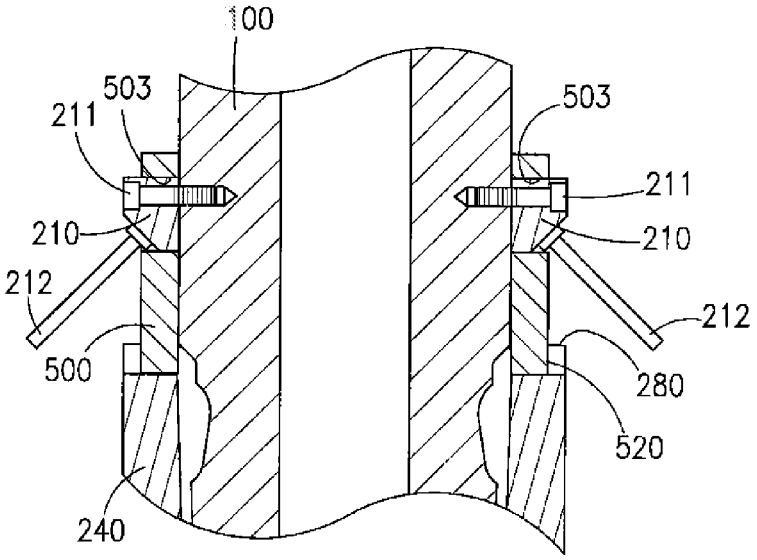
FIG. 20 depicts a section view of a spline torque ring of the present invention in an engaged position.
Figure 21:
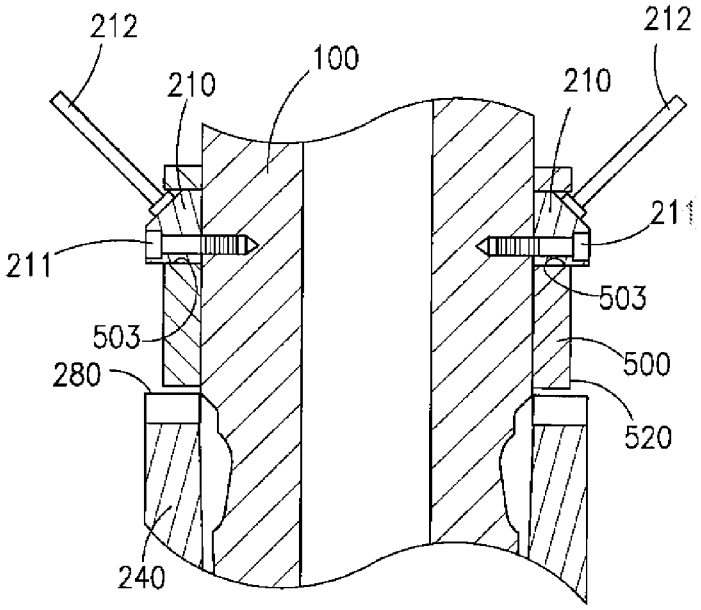
FIG. 21 depicts a section view of a spline torque ring of the present invention in a disengaged position.

FIG. 20 depicts a side section view of spline torque ring 500 of the present invention in an engaged position, while FIG. 21 depicts a section view of spline torque ring 500 of the present invention in a disengaged position. Eccentric cams 210 are disposed within substantially rectangular apertures 503 of spline torque ring 500 and are pivotally mounted to upper sub assembly 100 using pivot pins 211. Levers 212 are connected to eccentric cams 210, and can be used to apply rotational force to eccentric cams 210 in order to rotate said cams about pivot pins 211. Rotation of such eccentric cams 210 applies axial force to said spline torque ring 500, driving said spline torque ring axially up or down, as desired.

Figure 14:
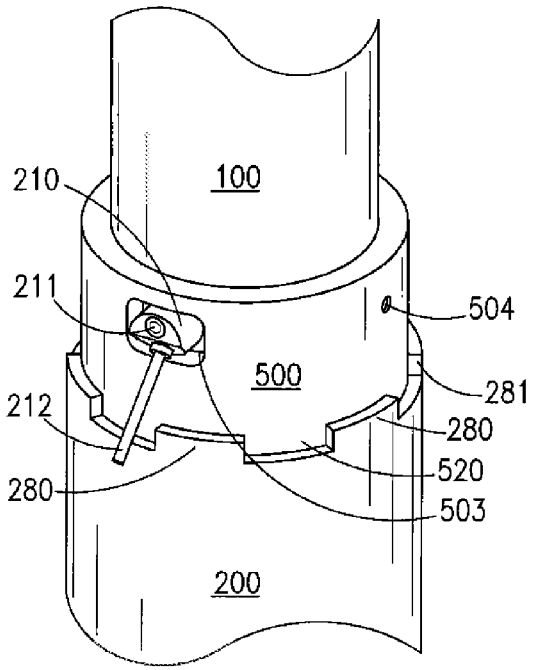
FIG. 14 depicts a perspective view of a spline torque ring of the present invention in an engaged position.

FIG. 14 depicts a perspective view of a spline torque ring 500 of the present invention in an engaged position. In this position, application of force to lever 212 results in rotation of eccentric cam 210 within substantially rectangular aperture 503 of spline torque ring 500, thereby driving said spline torque ring axially downward. In this position, face dogs 520 become engaged with face dogs 280 of central body member 200, such that shoulders 521 (not clearly visible in FIG. 14) of face dogs 520 contact shoulders 281 of face dogs 280, and permit the transfer of torque between such mating face dogs.

Figure 15:
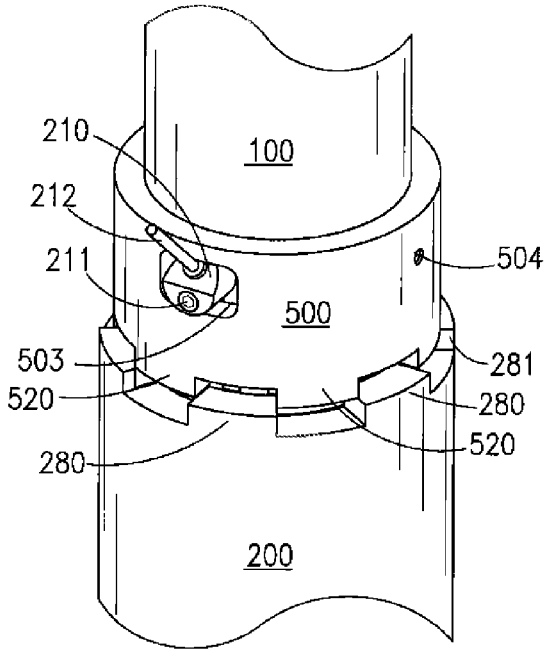
FIG. 15 depicts a perspective view of a spline torque ring of the present invention in a disengaged position.

FIG. 15 depicts a perspective view of a spline torque ring 500 of the present invention in a disengaged position. In this position, application of force to lever 212 results in rotation of eccentric cam 210 within substantially rectangular aperture 503 of spline torque ring 500, thereby driving said spline torque ring axially upward and away from central body member 200. In this position, face dogs 520 are not engaged with face dogs 280 of central body member 200, such that shoulders 521 of face dogs 520 do not contact shoulders 281 of face dogs 280, and do not permit the transfer of torque between such face dogs.

Figure 16:
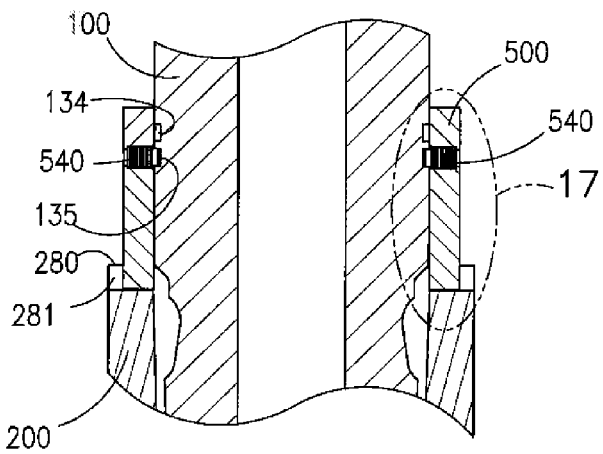
FIG. 16 depicts a side section view of a spline torque ring of the present invention locked in an engaged position.
Figure 17:
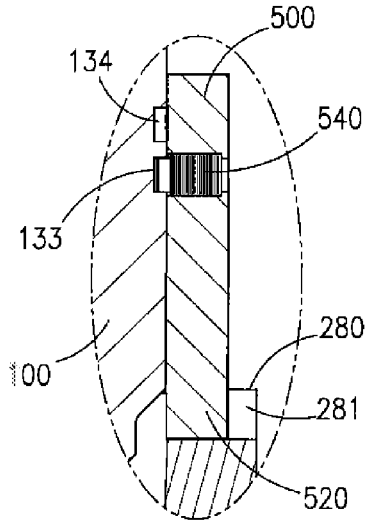
FIG. 17 depicts a detailed side section view of a portion of spline torque ring depicted in FIG. 16.

FIG. 16 depicts a side section view of spline torque ring 500 of the present invention in an engaged position, such that face dogs 520 of said spline torque ring are engaged against face dogs 280 of central body member 200. Set screws 540 can be installed into threaded set screw bores 504 to engage with set screw bore 133 in upper body member 100 and lock said spline torque ring 500 in a lower "engaged" position. FIG. 17 depicts a detailed side section view of a portion of spline torque ring 500 depicted in FIG. 16.

Figure 18:
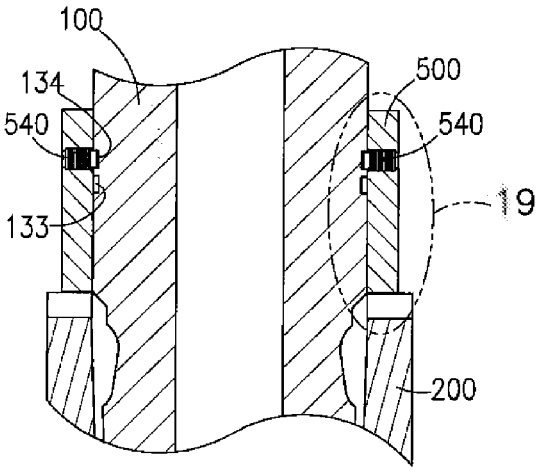
FIG. 18 depicts a side section view of a spline torque ring of the present invention locked in a disengaged position.
Figure 19:
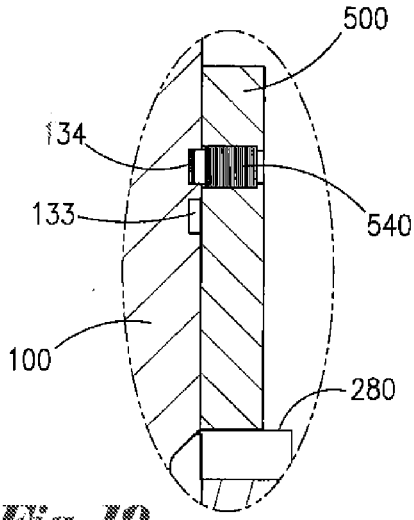
FIG. 19 depicts a detailed side section view of a portion of spline torque ring depicted in FIG. 18.

FIG. 18 depicts a side section view of a spline torque ring 500 of the present invention in a disengaged position, such that face dogs 520 of said spline torque ring are not engaged against face dogs 280 of central body member 200. Set screws 540 can be installed into threaded set screw bores 504 to engage with set screw bore 134 in upper body member 100 and lock said spline torque ring 500 in an upper "disengaged" position. FIG. 19 depicts a detailed side section view of a portion of spline torque ring 500 depicted in FIG. 18.

Figure 4:
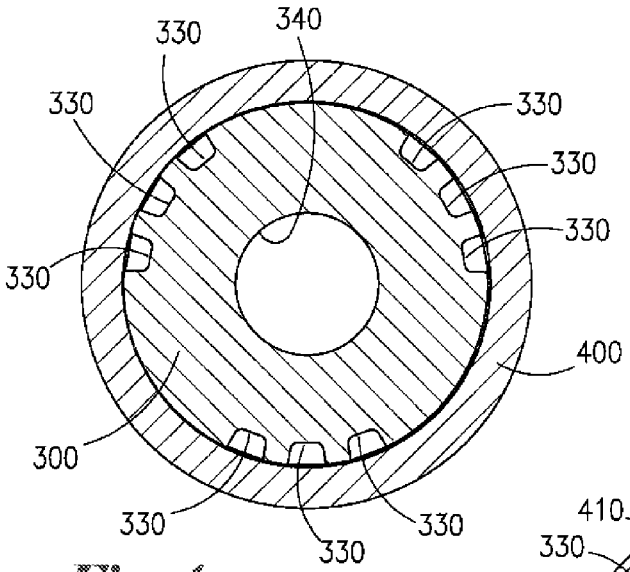
FIG. 4 depicts a section view of the cement head assembly of the present invention along line 4-4 of FIG. 2B.
Figure 5:
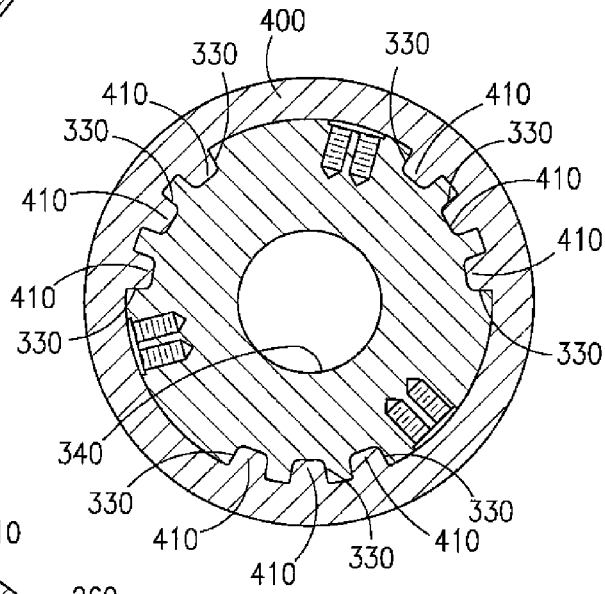
FIG. 5 depicts a section view of the cement head assembly of the present invention along line 5-5 of FIG. 2B.
Figure 6:
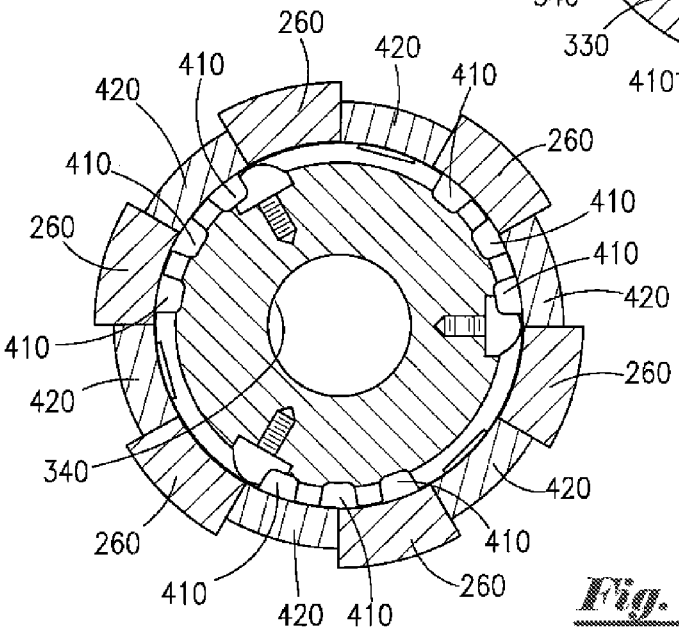
FIG. 6 depicts a section view of the cement head assembly of the present invention along line 6-6 of FIG. 2B.

Referring to FIGS. 4 through 6, FIG. 4 depicts a section view of cement head assembly 10 of the present invention along line 4-4 of FIG. 2B. Lower sub assembly 300 has central flow bore 340. Spline torque ring 400 is concentrically and slidably disposed on said lower sub assembly 300. Spline grooves 330 are disposed around, and recessed within, the outer surface of lower sub assembly 300.

FIG. 5 depicts a section view of cement head assembly 10 of the present invention along line 5-5 of FIG. 2B. Lower sub assembly 300 has central flow bore 340. Spline torque ring 400 is concentrically and slidably disposed on said lower sub assembly 300. Spline teeth 410 are received within spline grooves 330, which are disposed around the outer surface of lower sub assembly 300.

FIG. 6 depicts a section view of cement head assembly 10 of the present invention along line 6-6 of FIG. 2B. Lower sub assembly 300 has central flow bore 340. Spline torque ring 400 is concentrically and slidably disposed on said lower sub assembly 300. Spline teeth 410 are disposed around the outer surface of lower sub assembly 300. Face dogs 420 of spline torque ring 400 engage with face dogs 260 of lower sub assembly 200.

As set forth in detail above, components of cement head assembly 10 that require movement or actuation can be beneficially operated using a remote control system. In the preferred embodiment of the present invention, such remote control system comprises a series of fluid communication hoses/lines. However, it is to be observed that other means of remote control can be utilized including, without limitation, fiber optics, infrared, sound waves, radio frequency, blue tooth technology, laser, ultrasound, pressure pulses, magnetic and/or other remote control technology. Further, control and monitoring can be accomplished by fluid pulses, hydraulic pressures, wave pulses, ultrasonic pulses or acoustic waves.

Valves that require or are expected to be fully open or fully closed during operation beneficially include indicators to signal whether such valves are in a fully open or fully closed position. Electronic or mechanical monitoring devices can be used to monitor multiple variables during operation of cement head assembly 10, such as force/torque on the assembly, heat, pressure, rotations, RPM, and/or other beneficial data.

Cement head assembly 10 may also beneficially permit the conversion of mechanical energy (by way of illustration, but not limitation, from fluid flow, tool movement or rotation) into electrical energy for use as an onboard power source. Further, said onboard power source may be derived from external elements such as solar power, wave energy, or wind power.

In operation, cement head assembly 10 of the present invention can be connected with necessary supply lines at an easily accessible location at or near the rig floor. By way of illustration, but not limitation, a cement slurry supply line can be attached to inlet sub 153 (or other applicable inlet to cement head assembly 10) using a flange type connection that will not inadvertently unscrew or become easily knocked loose. Similarly, hydraulic control lines (such as lines 40 depicted in FIG. 1A) and torque tie-down chains can also be attached to said cement head assembly 10 at or near the rig floor. Cement head assembly 10 can also be preloaded with darts or other droppable objects or, if desired, can be quickly and efficiently loaded at a well site. By allowing such lines, chains, etc. to be connected at or near the rig floor, cement head assembly 10 of the present invention eliminates the need for lifting personnel to an elevated location on a riding belt or basket in order to attach such lines, thereby eliminating the significant risks associated with falling personnel and dropped objects.

Once connected, cement head assembly 10 of the present invention can be picked up by a top drive unit (or connected to a CRT affixed to a top drive unit), and cementing or other pumping operations can be performed. With spline torque rings engaged, spline teeth of such spline torque rings mate with and engage against spline grooves (on upper sub assembly or lower sub assembly, as applicable). Further, end dogs of said spline torque rings mate with and engage against end dogs of central body assembly 200. In this manner, torque (for example, from a top drive unit) will be transferred through cement head assembly 10 allowing rotation of said assembly, but without resulting in disconnection or detachment of components of said cement head assembly 10.

In the event that it becomes necessary, cement head assembly 10 of the present invention can be easily lowered to the rig floor or other convenient location. The interrupted screw connections of the present invention can be used to quickly and efficiently separate the various components of a cement head when access to the internal space or components of such cement head is required at a well location. Although there are many different reasons why such access may be required, common examples include the need to physically access plugs, darts, balls or other objects, or to reload such items within a cement head.

In order to accomplish such disconnection, set screw(s) can be removed from said spline torque ring(s). Lever 212 can be operated to rotate eccentric cams 210 with substantially rectangular apertures of spline torque ring 400 and/or 500, resulting application of axial forces to said spline torque ring(s). Said spline torque ring(s) can slide away from central body assembly 200, thereby disengaging mating end dogs. Additionally, control lines (such as lines 50) can be detached using quick-connect connections. With spline torque ring(s) disengaged and the appropriate control or other lines disconnected, the desired interrupted screw connection(s) can be broken out. Such disconnection is quick and efficient, and does not require use of specialized equipment (such as a bucking machine) and/or excessive personnel. When desired, the components of the present invention can be quickly and easily reattached, and the cement head assembly 10 of the present invention can be picked up and returned to service.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A cement head comprising:

a) a sub assembly having a bore for fluid flow and at least one groove disposed on said sub assembly, wherein said at least one groove is oriented substantially parallel to the bore of said sub assembly;

b) a body member joined to said sub assembly, said body member having a bore for fluid flow in fluid communication with the bore of said sub assembly, and a dog recess;

c) a connection assembly for joining said sub assembly to said body member, said connection assembly comprising:

i) a in end connector having interrupted threads;

ii) a mating box end connector having interrupted threads;

d) a ring having a top, a bottom, a length, an internal surface, at least one face dog, a substantially rectangular aperture extending through said ring and at least one spline disposed on said internal surface, wherein said ring is slidably received on said sub assembly, said at least one spline is received within said at least one groove on said sub assembly, and said at least one face dog is received within said at least one dog recess on said body member; and e) an eccentric cam disposed within said substantially rectangular aperture and rotatably connected to said sub assembly, wherein rotation of said eccentric cam applies axial force to said ring.

2. The cement head of claim 1, further comprising at least one droppable object disposed within said body member.

3. The cement head of claim 2, wherein said at least one droppable object comprises a dart, plug or ball.

4. The cement head of claim 1, wherein said at least one sub assembly is connected to a casing running tool.

5. A cement head comprising:

a) a body member having an upper end having at least one dog recess, a lower end having at least one dog recess and a bore extending from said upper end to said lower end, a first box end connector having interrupted threads at said upper end, and a second box end connector having interrupted threads at said lower end;

b) an upper sub assembly having a bore for fluid flow in fluid communication with the bore of said body member, at least one groove disposed on said upper sub assembly wherein said at least one groove is oriented substantially parallel to the bore of said upper sub assembly, and a pin end connector having interrupted threads wherein said pin end connector is mated with the first box end connector of said body member;

c) a lower sub assembly having a bore for fluid flow in fluid communication with the bore of said body member, at least one groove disposed on said lower sub assembly oriented substantially parallel to the bore of said lower sub assembly, and a pin end connector having interrupted threads wherein said in end connector is mated with the second box end connector of said body member;

d) a first ring having a top, a bottom, a length, an internal surface, at least one face dog and at least one spline disposed on said internal surface, wherein said first ring is slidably received on said upper sub assembly, said at least one spline is received within said at least one groove on said upper sub assembly, and said at least one face dog is received within said at least one dog recess on the upper end of said body member;

e) a second ring having a top, a bottom, a length, an internal surface, at least one face dog and at least one spline disposed on said internal surface, wherein said second ring is slidably received on said lower sub assembly, said at least one spline is received within said at least one groove on said lower sub assembly, and said at least one face dog is received within said at least one dog recess on the lower end of said body member;

f) a first eccentric cam disposed within a substantially rectangular aperture in said first ring and rotatably connected to said upper sub assembly, wherein rotation of said eccentric cam applies axial force to said first ring; and g) a second eccentric cam disposed within a substantially rectangular aperture in said second ring and rotatably connected to said lower sub assembly, wherein rotation of said second eccentric cam applies axial force to said second ring.

6. The cement head of claim 5, further comprising at least one droppable object disposed within said body member.

7. The cement head of claim 6, wherein said at least one droppable object comprises a dart, plug or ball.

8. The cement head of claim 5, wherein said at least one sub assembly is connected to a casing running tool.

9. A method of performing cementing operations comprising the steps of:

a. connecting flow lines to a cement head at a rig floor, said cement head comprising:

i) a sub assembly having a bore for fluid flow and at least one groove disposed on said sub assembly, wherein said at least one groove is oriented substantially parallel to the bore of said sub assembly;

ii) a body member joined to said sub assembly, said body member having a bore for fluid flow in fluid communication with the bore of said sub assembly, and a dog recess;

iii) a connection assembly for joining said sub assembly to said body member, said connection assembly comprising:

aa) a pin end connector having interrupted threads; and bb) a mating box end connector having interrupted threads;

cc) a ring having a top, a bottom, a length, an internal surface, at least one face dog, a substantially rectangular aperture extending through said ring, and at least one spline disposed on said internal surface, wherein said ring is slidably received on said sub assembly, said at least one spline is received within said at least one groove on said sub assembly, and said at least one face dog is received within said at least one dog recess on said body member;

dd) an eccentric cam disposed within said substantially rectangular aperture and rotatably connected to said sub assembly, wherein rotation of said eccentric cam applies axial force to said ring;

b. lifting said cement head off of the rig floor;

c. pumping fluid through said cement head;

d. lowering said cement head to the rig floor;

e. breaking said connection assembly apart at the rig floor;

f. re-connecting said connection assembly; and g. resuming pumping through said cement head.

10. The method of claim 9, further comprising at least one droppable object disposed within said body member.

11. The method of claim 10, wherein said at least one droppable object comprises a dart, plug or ball.

12. The method of claim 9, wherein said at least one sub assembly is connected to a casing running tool.

* * * * *